United States Patent [19]

Law

[11] Patent Number: 4,643,696

[45] Date of Patent: Feb. 17, 1987

[54] VEHICLE WHEEL WITH CLUTCH MECHANISM AND SELF ACTUATED EXTENDING CLAWS

[75] Inventor: N. Y. Law, Kowloon, Hong Kong

[73] Assignee: Soma International Ltd., East Kowloon, Hong Kong

[21] Appl. No.: 822,837

[22] Filed: Jan. 27, 1986

[51] Int. Cl.[4] ..... A63H 17/00

[52] U.S. Cl. ..... 446/465

[58] Field of Search ..... 446/465, 457, 462, 463; 301/48, 51, 43, 45, 46

[56] References Cited

U.S. PATENT DOCUMENTS

| | | | |
|---|---|---|---|
| 1,781,461 | 11/1930 | Huenemann | 301/48 |
| 1,890,872 | 12/1932 | Van Kleeck | 301/51 |
| 4,547,173 | 10/1985 | Jaworski et al. | 446/457 |

FOREIGN PATENT DOCUMENTS

| | | | |
|---|---|---|---|
| 1532724 | 7/1968 | France | 301/48 |

*Primary Examiner*—Mickey Yu

*Attorney, Agent, or Firm*—Buell, Ziesenheim, Beck & Alstadt

[57] ABSTRACT

A vehicle wheel having claws which automatically extend whenever the wheel strikes an obstacle and automatically retract when the obstacle is overcome is disclosed. The wheel also includes a ratchet type clutch mechanism which permits the wheel to be manually turned while the wheel drive shaft is fixed, thereby preventing damage. The wheel includes a spindle having at least one claw pivotally attached to the spindle. A wheel body is fitted over the spindle having one aperture for each claw attached to its front face and a circle of teeth on its back face. A hub having at least one radially extending arm is attached to the shaft or axle which turns the wheel. A tooth is provided on each arm to engage the teeth on the spindle. A wheel body is fitted over the spindle having one aperture for each claw attached to the spindle which apertures are sized and positioned so that a claw may pass through the aperture when the spindle is rotated relative to the body. A spring connects the wheel body to the spindle in a manner so that when the spindle turns and no restraining force is acting on the wheel body, the wheel body will also turn. However, when a force is applied to the wheel body restraining it from turning, the spindle is permitted to rotate a distance sufficient to allow each claw on the spindle to pivot and extend through an aperture in the wheel body. When the force is removed from the wheel body the spring causes the wheel body to rotate at a speed greater than the rotation of the spindle thereby retracting the extended claws.

4 Claims, 11 Drawing Figures

20
22
27
24
25
26
14
58
10
11
12
13
40
42
51
52
50
53
54
55
41
88
82
84
86
43
56

VEHICLE WHEEL WITH CLUTCH MECHANISM AND SELF ACTUATED EXTENDING CLAWS

FIELD OF THE INVENTION

This invention relates to a vehicle wheel having a clutch mechanism which permits the wheel to be manually rotated while the wheel drive shaft is fixed and at least one claw which will extend through an aperture in the treaded surface of the wheel when the wheel is restrained from rotating. When the restraining force is removed from the wheel the claws will retract into the interior of the wheel.

DESCRIPTION OF THE PRIOR ART

Many vehicles have been designed to climb over objects and negotiate rugged terrain. A common solution to this problem for both toy vehicles and full sized vehicles is the use of four wheel drive. That is, power is supplied to all four wheels of the vehicle. Another solution to the problem is the use of oversized wheels. Still another solution to the problem is the use of extremely exaggerated tread patterns. In my U.S. Pat. No. 4,443,968 I disclose a 4-wheel drive vehicle having extremely exaggerated tread patterns.

Recently a toy vehicle having wheels with claws that extend from the tread surface of the wheel was introduced by Galoob Toys. The wheels of this vehicle have three apertures in the tread surface. Three claws are provided in the interior of the wheel and are oriented so that one claw may extend through each aperture. A locking hub mechanism is provided in the wheel for positioning the claws in one of three positions. When the hub is in a first locked position the claws will be retracted into the interior of the wheel and will not extend from the wheel. When the hub is in a second position the claws will extend automatically if power is applied to the wheel and a restraining force acts upon the exterior of the wheel. As the hub is turned to a third position the claws will extend from the tread of the wheel and become locked in an extended position. If the wheel is rotated in a reverse direction with the claws extended, the claws are likely to be broken. This vehicle also should not be turned while the claws are extended as turning the vehicle may cause the claws to break. For that reason any vehicle having these prior art wheels should not be provided with a motor capable of running the vehicle in a reverse direction. Indeed, the Galoob vehicle will only go forward.

The Galoob vehicle is designed so that opposite wheels will turn at the same rate thereby maintaining an alignment between the claws of these two wheels. While that feature is desirable to provide better traction for the vehicle when the claws are extended, a disadvantage of this system is that one cannot turn one wheel while holding the opposite wheel. If one tries to force that wheel to turn, the wheel will be damaged.

OBJECTS OF THE INVENTION

It is an object of this invention to provide a vehicle wheel having a clutch mechanism and claws which will extend when the vehicle is faced with an obstacle and which will retract automatically when the vehicle overcomes the obstacle. The clutch mecahanism allows the wheel to be turned clockwise or counterclockwise without damaging the claws, the wheel or the vehicle. It is a further object of this invention to provide a vehicle wheel having automatically extending claws which will retract when the vehicle is turned or moves in a reverse direction. It is a further object of the invention to provide a vehicle wheel which has retractable claws that will automatically retract when a greater force acts on the claws in a reverse or side direction than is acting on the vehicle wheel.

DESCRIPTION OF THE PREFERRED EMBODIMENTS

Figure 1:
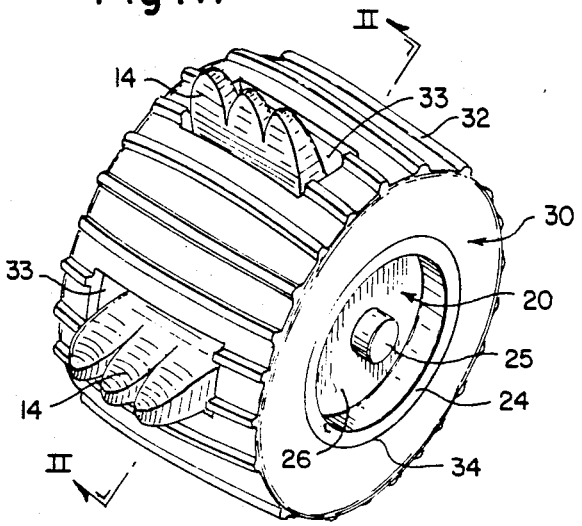
FIG. 1 is a perspective view of a first present preferred embodiment of my vehicle wheel with the claws extended.
Figure 2:
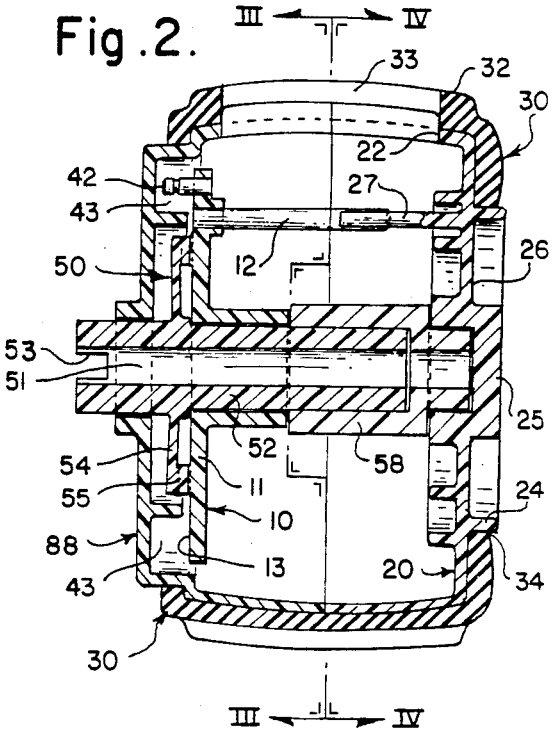
FIG. 2 is a cross sectional view of a first present preferred embodiment of my vehicle wheel taken along the line II—II of FIG. 1.

As shown in FIG. 1, my vehicle wheel is comprised of a vehicle body 20 preferably having a tire 30 mounted thereon. Apertures 22 and 33 are provided in the wheel body and tire through which claws 14 may extend when the wheel body is restricted from turning. A rim 24 and hub 25 are also provided on the outer face 26 of the wheel body 20. I have developed two present preferred embodiments of my wheel. Both embodiments look almost identical when assembled, and appear as shown in FIG. 1. However, the interior mechanism which holds the claws and causes them to extend differs between the two embodiments. A wheel containing the first preferred mechanism is shown in FIGS. 2 thru 7. In FIGS. 8 thru 11 I show a second preferred embodiment.

Figure 3:
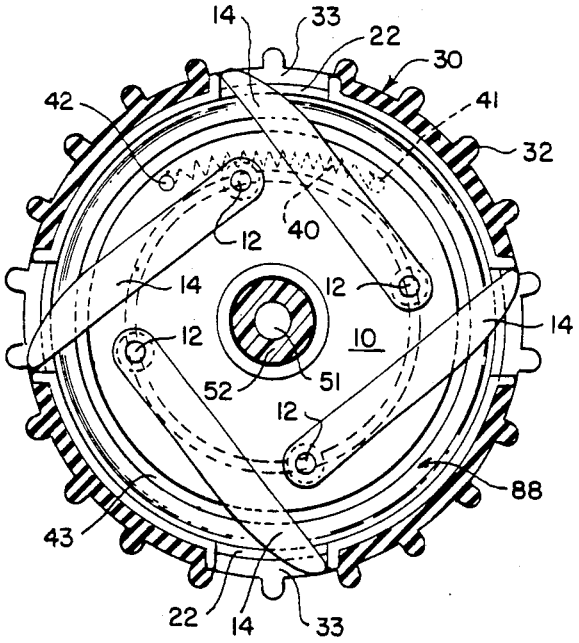
FIG. 3 is a cross-sectional view taken along the line III—III of FIG. 2 wherein the claws are shown in elevation.
Figure 4:
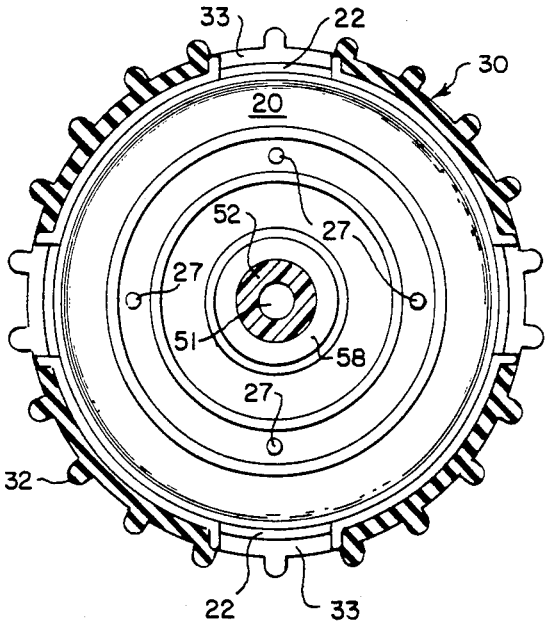
FIG. 4 is a cross sectional view along the lines IV—IV of FIG. 2 wherein the claws are not shown.
Figures 5, 6, 7:
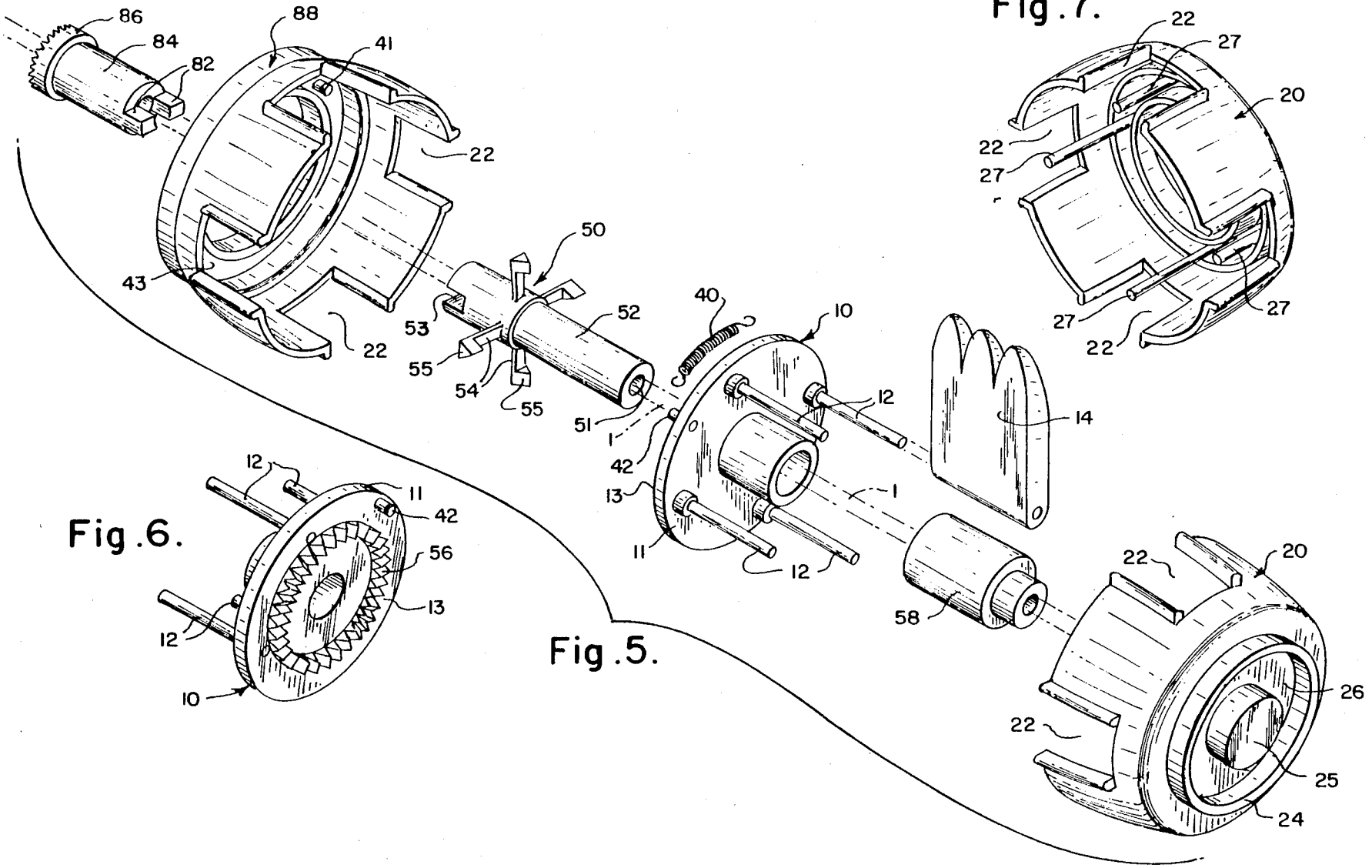
FIG. 5 is an exploded view of the first present preferred embodiment of my vehicle wheel without a tire.
FIG. 6 is a rear perspective view of the spindle shown in FIG. 5.
FIG. 7 is a rear perspective view of the outer half of the wheel body shown in FIG. 5.
Figure 11:
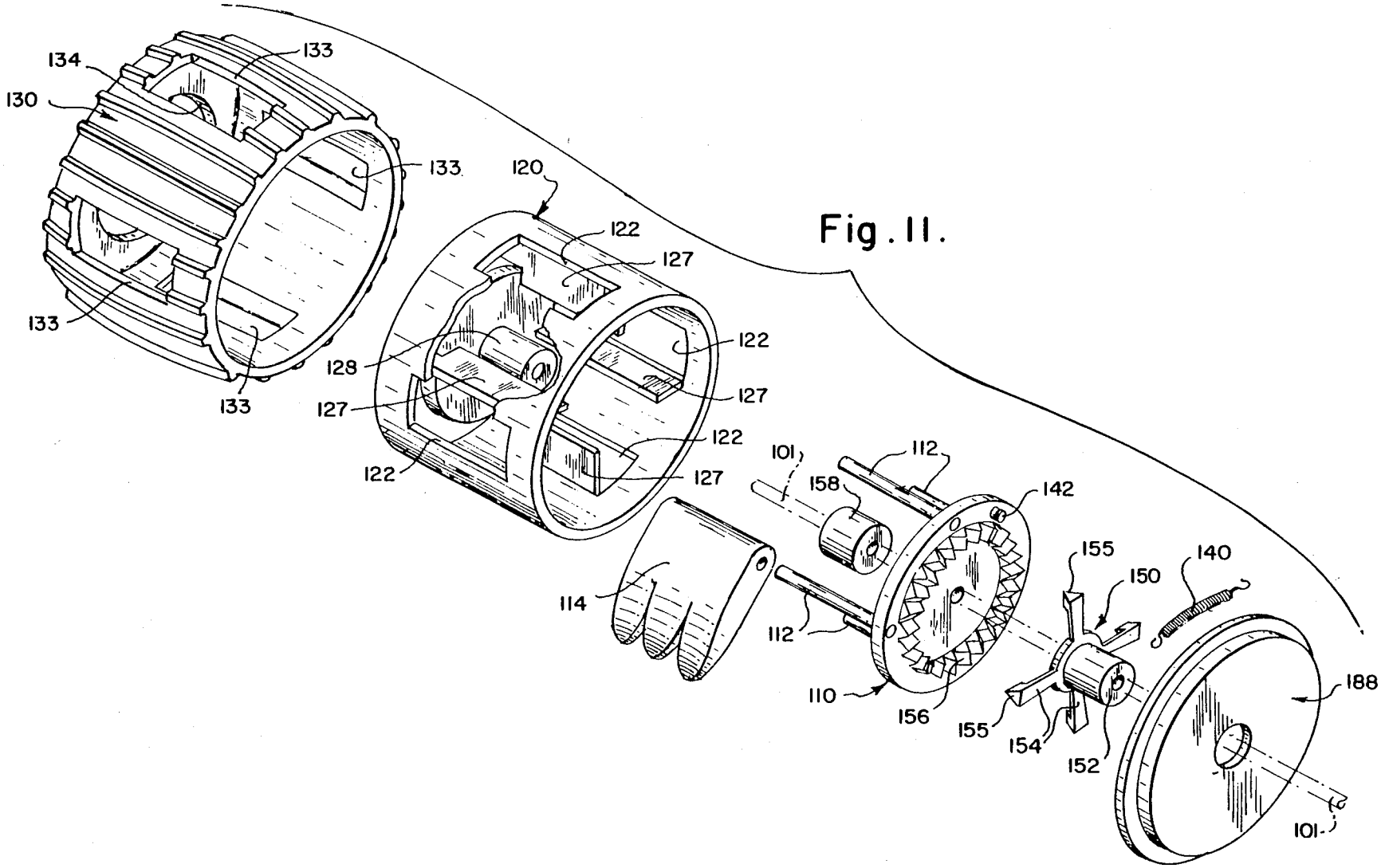
FIG. 11 is an exploded view of the second present preferred embodiment of my vehicle wheel viewed from a rear perspective.

Referring to FIGS. 2 thru 7, I provide a spindle 10, having posts 12 extending from the front face 11 of the spindle. A claw 14 is pivotably attached to each spoke 12. The claws are sized and positioned so that they may be nested within the outer circumference of the spindle 10 as shown in FIG. 3. The claws 14 are also sized so as to extend beyond the outer circumference of a wheel body 20 when pivoted about spokes 12. I prefer to provide four claws 14 as shown, but a lesser or greater number of claws could be used. Wheel body 20 is fitted over spindle 10. Apertures 22 are provided in body 20. These apertures 22 are sized and positioned so that one claw 14 may extend through each aperture 22. As shown in FIGS. 1 and 5, I prefer to provide a rim 24 and hub 25 on the front face 26 of the body 20. I further prefer to provide a tire 30 having treads 32 about its circumference. The tire 30 is preferably stretched over body 20. Apertures 33 are provided in the tire which are sized and positioned to align with apertures 22 in the wheel body 20. Another aperture 34 is provided on the face of the tire 30 and sized so that rim 24 will fit through the aperture 34. I prefer to make the tire 30 of rubber or other elastomeric material so that it can be stretched and fitted over body 20. Spindle 10 is fitted inside wheel body 20. Then a mating half, or cover, 88 is attached to the wheel body 20 so that cover 88 may not move relative to the body 20. As shown in FIGS. 5 and 11, the body and cover can take at least two forms. In the second embodiment, shown in FIG. 11, the body 120 is cup-shaped and cover 188 is disk shaped. In the first embodiment both the body 20 and cover 88 are cup-shaped and snap together to define apertures 22.

The spindle 10 is sized so that it may turn freely inside the wheel body. As explained in more detail below, the driving force is applied to the spindle 10. This can be done by attaching the spindle 10 to the axle to which power is applied. A spring 40 is attached from post 41 (FIG. 3) on cover 88 to post 42 (FIGS. 2, 3 and 5) on spindle 10. When spindle 10 is turned, spring 40 is stretched until the wheel body begins to turn. At this point claws 14 will remain inside the wheel body as shown in FIG. 3. Whenever a restraining force is applied to the wheel body or tire preventing them from turning, spindle 10 will continue to turn until spring 40 is fully stretched. At this point, claws 14 will be fully extended. When the restraining force is removed from the wheel body, spring 40 will return to its former position, shown in FIG. 3, thereby retracting the claws 14 to the position of FIG. 3. A slot 43 is provided in the face of cover 88 in which spring 40 may nest. The orientation of the spring 40 and post 42 will be on the right side of post 41 for wheels on a given side of a vehicle and on the left side of post 41 for wheels on the opposite side of the vehicle.

When the wheel is assembled I want the claws to be retracted as shown in FIG. 3. I also want to have sufficient tension on spring 40 when the claws are extended so that the claws will retract when no restraining force is acting on the wheel body. It is, therefore, necessary that pins 41 and 42 be oriented to provide sufficient tension on spring 40 as shown in FIG. 3. To achieve the desired position of pins 41 and 42, I select a spring having an appropriate length, size and spring properties. I insert the spindle 10 into body 20 attaching spring 40 to posts 41 and 42 during insertion. Holding the wheel body firmly I turn spindle 10 to tension spring 40. This causes posts 41 and 42 to move away from one another. For the wheel in FIG. 3 the spindle 10 must be rotated counter-clockwise. Then I insert the spindle 10 into the body wheel. The spring 40 will cause the wheel body to rotate relative to the spindle until the claws 14 hit stops 27 (FIG. 7). At this point the claws will be retracted.

I also provide a clutch mechanism 50. This mechanism enables the wheel to turn while the driving axle or stub shaft remains fixed. This clutch gives two important benefits. First it allows me to adjust all the wheels on a vehicle so that the apertures are similarly oriented. This is desirable because when the claws 14 extend from wheels positioned opposite one another, corresponding claws from each wheel will grasp an object in front of or below the wheels at the same time. The clutch mechanism also permits a child to manually turn the wheel when no driving power is applied. This prevents a child from damaging the wheel or the vehicle if he tries to manually turn the wheel. Because a child is likely to want to see the claws while the vehicle is stopped, there is a tendency for children to try to turn my wheel manually. Both preferred embodiments have a similar clutch mechanism. Let us first refer to FIGS. 5 and 6 to see the parts of this mechanism in the first preferred embodiment. The clutch mechanism 50 is comprised of a clutch hub 52 having an aperture 51 through which an axle 1 (partially shown in chain line) may pass. Preferably, aperture 51 is sized so that axle 1 may freely turn within the hub 52. In this embodiment the axle 1 is used merely to align the components. No power is applied to the axle. Extending from the body of clutch 50 are a plurality of arms 54, each having a tooth 55 at its distal end. A circle of mating teeth 56 (FIG. 6) are provided on the back face 13 of spindle 10. These teeth are sized and positioned so as to mate with teeth 55 of the clutch 50. Clutch hub 52 contains a slot 53 into which tabs 82 on wheel shaft 84 fit. The stub shaft 84 is driven by the vehicle's drive train which has a gear (not shown) that meshes with crown gear 86 on the end of wheel shaft 84. Spindle 10 fits over and freely rotates around the body of clutch hub 52. To keep teeth 55 and 56 engaged, spacer 58 is provided. I prefer to attach spacer 58 to clutch hub 52 so that clutch arms 54 are in tension thereby keeping teeth 55 and 56 engaged. When wheel shaft 84 is driven, clutch 50 will turn. Because teeth 55 and 56 are engaged, spindle 10 will turn when clutch 50 turns. When no power is applied to the stub shaft 84, it will not turn. Since clutch 50 interlocks with stub shaft 84 through tabs 82 and slot 53, clutch 50 also will not turn. Should someone try to rotate the wheel body, stops 27 will abut claws 14 and exert force on the spindle 10. Without a clutch it is possible that sufficient force could be applied to break stops 27. The clutch 50 allows spindle 10 to rotate in either direction while wheel shaft 84 stays in a fixed position. Consequently, one cannot break stops 27 by turning the wheel body 20.

In the second preferred embodiment shown in FIGS. 8 thru 11 the driving force is applied to the axle. In these figures like parts have the same reference number given the parts in the first embodiment plus 100. As shown in FIG. 11, clutch 150 is fixed onto the axle 101 (shown in chain line) in FIG. 11. Axle 101 is driven by the vehicle's drive system and functions like wheel shaft 84 of the first embodiment. The clutch will rotate when the axle is turned. A plurality of arms 154 extend from the clutch hub 152. A tooth 155 is provided at the end of each arm 154. A spacer 158 is attached to axle 101. Clutch 150 and spacer 158 are sized and positioned so as to maintain teeth 155 in engagement with teeth 156 on spindle 110. A second spacer 128 attached to body 120 keeps spindle 110 aligned so that claws 114 attached to the spindle may extend through apertures 122. Despite the structural differences between the two embodiments here illustrated, the clutch mechanism operates the same way in both embodiments.

The second preferred embodiment contains a single cup-shaped wheel body 120 to which a disk-like cover 188 is attached. The same tire 30 can be used in both embodiments. Stops 127 are provided in the body to restrict movement of claws 114. These claws 114 are sized to fit through apertures 122 in body 120 and apertures 33 in tire 30. A spring 140 positioned in channel 143 of cover 188 extends from post 141 on cover 188 to post 142 on spindle 110.

Figure 8:
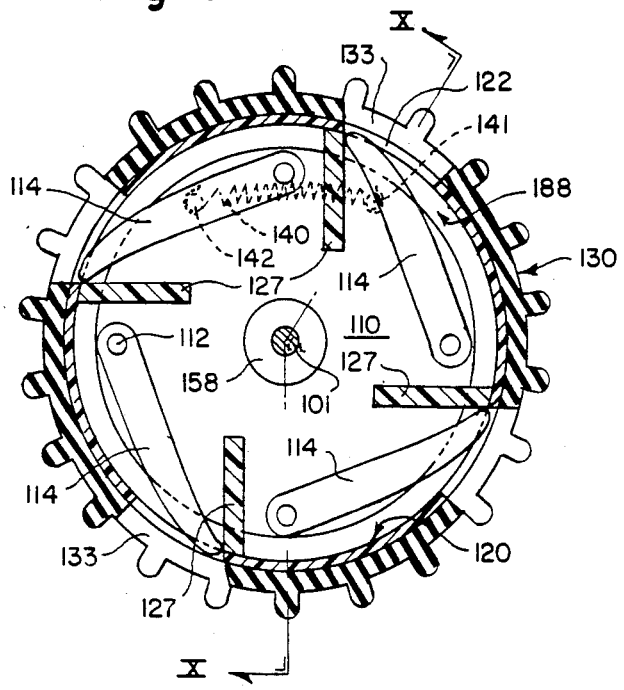
FIG. 8 is a cross sectional view similar to FIG. 3 of a second preferred embodiment of my vehicle wheel.
Figure 10:
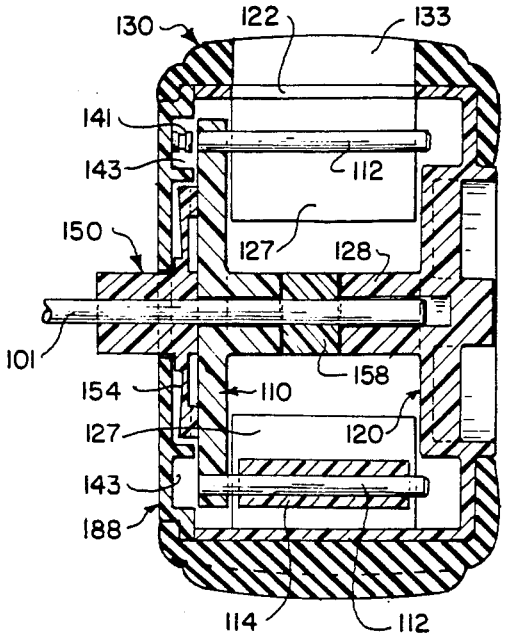
FIG. 10 is a sectional view taken along the lines X—X of FIG. 8.
Figure 9:
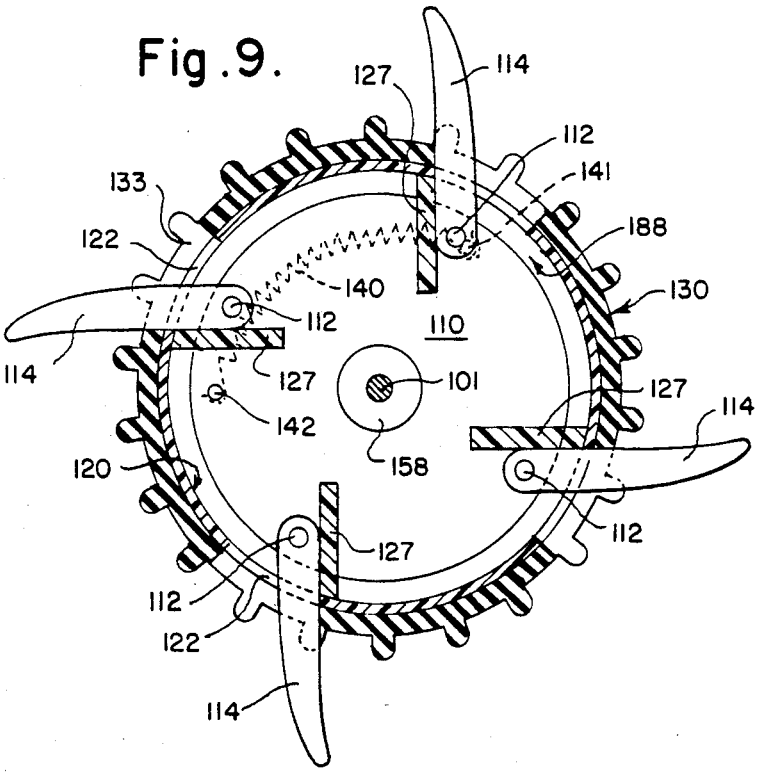
FIG. 9 is a cross-sectional view similar to FIG. 8 but showing the claws extended.

The operation of the wheels can best be understood by referring to FIGS. 8, 9 and 10. First, it should be recognized that spindle 110 will rotate when the axle 101 turns. Thus, whenever axle 101 is rotated spindle 110 will turn in the same direction and at the same speed as the axle. On the other hand, wheel body 120 with attached cover 188 and tire 130 are not firmly attached to axle 101. If spring 140 is not connected the wheel body 120 will rotate freely. Spring 140 extends from post 141 on cover 128 to post 182 on spindle 110. Rotation of the axle and attached spindle 110 will cause spring 140 to stretch and to pull cover 188 and attached wheel body 120 along with the turning spindle. Thus, when axle 101 is driven the wheel body will turn at the same rate as the axle and spindle. Under those circumstances claws 114 will remain nested inside of the wheel as shown in FIG. 8. If the wheel strikes an object or other force acts on the wheel to prevent the wheel body from turning, axle 101 and spindle 110 will continue to turn until spring 140 is fully extended or until a stop means 127, provided on the interior of wheel body 120, prevents spindle 110 from turning as shown in FIG. 9. When spindle 110 turns relative to wheel body 120, claws 114 will pivot on pins 112 and extend through apertures 122 beyond the treaded surface of the wheel. Whenever the obstacle is overcome or the force preventing wheel body 120 from turning is removed, spring 140 will cause the wheel body 120 to rotate faster then spindle 110 until spring 140 reaches the preset equilibrium condition. At that time claws 114 will have retracted from the extended position shown in FIG. 9 to the nested position of FIG. 8. While I have illustrated the use of a coil spring 140, it should be apparent that other springs and resilient or elastomeric members could be used to connect cover 128 to spindle 110.

Although I have described and illustrated a present preferred embodiment of my invention, it should be distinctly understood that the invention is not limited thereto, but may be variously embodied within the scope of the following claims.

I claim:

1. A vehicle wheel having self actuated claws which may extend therefrom comprising (a) a wheel shaft adapted to be driven by a drive train of a vehicle;

(b) a spindle positioned in line with the wheel shaft said spindle comprised of (i) a generally circular body having a front face, a back face, and an aperature through which the wheel shaft may pass, (ii) at least one post attached to the front face of the body, and (iii) a series of teeth attached to the back face of the body and positioned to encircle the aperture through which the wheel shaft may pass;

(c) a clutch mechanism comprised of (i) a hub which is attached to the wheel shaft, and (ii) at least one arm attached to and radially extending from the hub and having a tooth at its distal end, said arm sized and positioned so that its tooth engages the tooth on the back face of the spindle;

(d) at least one claw pivotably attached to the post on the spindle, sized and positioned so that the claw may be positioned within an outer circumference of a wheel body and then be pivoted to extend beyond the outer circumference of the wheel body;

(e) a wheel body sized to fit over the spindle, having one aperture for each claw attached to the spindle, and positioned over the spindle so that each claw may pass through a body aperture when the spindle is rotated relative to the body;

(f) a spring connected between the body and the spindle so that (i) when the spindle turns and no restaining force is acting on the body, the body will also turn, both the body and the spindle will rotate at a single speed, and the claws will be positioned within an outer circumference of the wheel body;

(ii) when a force is applied to the wheel body restraining the body from turning, the spindle may rotate a distance sufficient to allow each claw to extend through an aperture in the wheel body; and (iii) when the force is removed from the body, the spring will cause wheel body to rotate faster than the spindle thereby retracting the extended claws.

2. The vehicle wheel of claim 1 also comprising a tire fitted over the wheel body.

3. The vehicle wheel of claim 2 wherein the tire is comprised of an elastomeric material.

4. The vehicle of claim 1 also comprising at least one stop attached to the interior of the wheel body to prevent the claws from moving beyond a predetermined distance.

* * * * *